US011512521B2

(12) United States Patent
Vansickle et al.

(10) Patent No.: US 11,512,521 B2
(45) Date of Patent: Nov. 29, 2022

(54) DRY INSTALL RECEPTOR SYSTEM

(71) Applicant: PEERLESS PRODUCTS, INC., Fort Scott, KS (US)

(72) Inventors: Jordan B. Vansickle, Fort Scott, KS (US); Joshua R. Mintz, Fort Scott, KS (US)

(73) Assignee: PEERLESS PRODUCTS, INC., Fort Scott, KS (US)

( * ) Notice: Subject to any disclaimer, the term of this patent is extended or adjusted under 35 U.S.C. 154(b) by 198 days.

(21) Appl. No.: 16/908,818

(22) Filed: Jun. 23, 2020

(65) Prior Publication Data

US 2021/0396069 A1 Dec. 23, 2021

(51) Int. Cl.
*E06B 1/60* (2006.01)
*E06B 3/26* (2006.01)
*E06B 1/36* (2006.01)

(52) U.S. Cl.
CPC ..... *E06B 1/60* (2013.01); *E06B 1/36* (2013.01); *E06B 1/6015* (2013.01); *E06B 3/26* (2013.01)

(58) Field of Classification Search
CPC ..... E06B 1/6015; E06B 1/36; E06B 1/60
See application file for complete search history.

(56) References Cited

U.S. PATENT DOCUMENTS 4,598,513 A * 7/1986 Gartner ..... E06B 1/36 52/235
5,038,537 A * 8/1991 Frambach ..... E06B 3/325 52/204.593
5,046,293 A * 9/1991 Kajiura ..... E06B 1/6015 52/235
5,619,828 A * 4/1997 Ver Meer ..... E06B 1/62 52/213
6,363,669 B1 * 4/2002 Hoffman ..... E06B 1/6015 52/202
7,669,382 B2 * 3/2010 Burton ..... E06B 1/6069 52/204.55
8,973,315 B2 * 3/2015 Massey ..... E06B 1/34 52/656.5
10,233,689 B1 * 3/2019 Jones ..... E06B 1/36
10,829,982 B2 * 11/2020 Jones ..... E06B 3/5885
2008/0282628 A1 * 11/2008 Lenox ..... E06B 3/26303 52/204.63
2009/0313941 A1 * 12/2009 Siodla ..... E06B 3/26303 52/656.2
2010/0251643 A1 * 10/2010 Rosende ..... E06B 1/62 52/204.2
2014/0260072 A1 * 9/2014 McKenna ..... E06B 3/16 52/741.4
2018/0058135 A1 * 3/2018 Vos ..... E06B 1/6069
2020/0199932 A1 * 6/2020 Jones ..... E06B 1/36
2021/0140173 A1 * 5/2021 Grise ..... E04B 1/665

* cited by examiner

*Primary Examiner* — Paola Agudelo
(74) *Attorney, Agent, or Firm* — Lathrop GPM LLP

(57) ABSTRACT

A kit for maintaining the compression of a glazing leg gasket extending around the entire perimeter of a receptor frame. Once the glazing unit is installed within the receptor frame, the kit includes at least one sill anchor block disposed atop the sill of the receptor for engagement with the glazing frame and at least one head retention clip operable to apply a force to the glazing frame and against the receptor frame. The at least one head retention clip is adjustable to vary the compressive force applied to the glazing leg gasket.

18 Claims, 6 Drawing Sheets

DRY INSTALL RECEPTOR SYSTEM

TECHNICAL FIELD

This disclosure is directed to a system and kit for achieving a specified compression of a dry glaze gasket by a glazing unit installed within a window receptor.

BACKGROUND

In commercial construction, glass is a versatile design element. It can serve decorative and functional purposes, and glass exterior facades are one of the most popular elements in modern mid- and high-rise design. Builders have numerous options for integrating glass into exterior walls, but two of the most common are curtain walls and window walls.

A window wall is achieved by placing glazing between a building's concrete slabs, using the slabs as structural support. Window walls have a break between the glass, with slab covers used to conceal the concrete. Window walls are often used in residential applications as they allow for more customizable sections such as windows and balcony doors. They are most commonly installed from the inside of a building, which is a safer, more efficient and more cost effective. Units are anchored at the head and sill and sealed in place using caulking.

Aside from advantages such as customizability, ease of installation and cost savings, window walls also require less engineering and safety considerations as the exterior wall is broken up by each floors' concrete slab, providing built-in fire stopping. Also, because the separation of each window wall unit creates a sealed space there is less noise transfer and energy loss. Further, if a unit becomes damaged and needs repair that specific unit can be removed and replaced without affecting the adjoining units.

With the advent of high performance reflective glasses, sealants, gaskets and other materials used in the glazing channel are exposed to considerable temperature extremes and high exposure to ultraviolet light. Temperatures of monolithic reflective glass in spandrel or non-vision areas have been measured at 190° F. This imposes considerable expansion and high temperature resistance requirements on all materials that encounter the glass. Depending on the type of glass, significant amounts of ultraviolet light can be reflected from the glass into the glazing material.

If the materials used in the glazing channel are affected by ultraviolet light, these materials most likely will degrade producing costly repairs on the project. Chosen glass materials must meet the architect's specifications for performance, which usually are: (1) Glass thickness and type (annealed, heat treated) to meet specified and wind load requirements, (2) Thermal efficiency requirements for both summer and winter conditions, (3) Aesthetic requirements, (4) Glass type to resist the potential of breakage due to thermal stress conditions, and (5) Building codes.

The glazing system should provide for minimum face clearances, edge clearances, and nominal bite. A nominal bite (the amount of overlap between the stop and the panel or lite) on the glass will provide adequate glass retention without excessive glass coverage. Adequate edge and face clearances will properly cushion the glass, thermally and mechanically isolate the glass framing members, and prevent glass to metal contact. Excessive glass coverage can increase thermal stresses at the glass edge. The glazing system must also have the capability of transferring wind and impact loads to the surrounding structure while cushioning the glass. It must accommodate thermal expansion and contraction of the frame and glazing materials.

Temperature differentials are caused by various adjoining material, shading patterns and shading devices. The receptor and glazing system must also prevent water penetration, prevent or minimize air infiltration or exfiltration, and create thermal barriers to prevent heat loss through the frame and condensation on the frame. At the same time, the system must also present an appearance consistent with design goals and retain its appearance and function over the anticipated life span of the building, given the maintenance program planned. The glazing system must also match any special performance required of the rest of the glazing components. Considerations that may influence the choice of glazing systems include the initial and replacement costs, and the workmanship available, since wet systems require better workmanship.

The installation of glass and the utilization of compression gaskets is referred to as dry glazing. Dry glazing systems utilize extruded gaskets as the glazing seals. This system is also referred to as compression gasket glazing because the system relies on compression of the glazing gasket to seal against air infiltration and water penetration. The gaskets are extruded to a specific shape to suit the application, often mating to an aluminum extrusion profile. Silicone, neoprene and ethylene propylene diene monomer (EPDM) are commonly used materials.

Dry glazing systems have become increasingly popular because they minimize on-site glazing requirements where craftsmanship, weather, and labor costs can adversely affect wet glazing methods. Nonetheless, even dry gasket systems typically require some strategic application when installed in the building condition.

Dry glazing is often used in a capture system wherein a heel bead is in the interior protected from UV exposure and provides a more reliable seal. The weather seal in these systems is produced by the compression of a dry gasket between a pressure plate and the glass surface. Failure to achieve adequate, uniform pressure on the gasket may result in air and water infiltration. Gaskets are generally designed to provide a uniform contact pressure of four to six pounds per inch to make the seal watertight and pressures of over ten pounds per inch should be avoided.

SUMMARY

The system disclosed herein is for maintaining the specified compression of a glazing leg gasket extending around the entire exterior perimeter of a receptor. A receptor is defined as additional framing components that encase, or surround, one or more window and/or door components. These are typically found in a glazed assembly. Receptor frames are used to effectively contain and drain water that infiltrates the enclosed window/door assembly and the joints between the window and the receptor frame itself.

Because a window unit is fabricated to exacting tolerances, the nesting qualities of the receptor framing can be used to take up the variations in rough window openings. While window units are generally fabricated and glazed on the factory floor under controlled conditions, receptor frames are typically assembled in the field. The quality of the construction can be affected by bad weather, extreme temperatures, dust, debris, other work in progress nearby, workmanship and supervision issues as well as various other challenges.

Designers continue to specify receptor frames to benefit from their inherent features, including water management and accommodation of building structural deflection. Window installers often continue to exhibit a preference for receptor frames, given their ability to facilitate the window installation process—in particular, accommodation of construction tolerances.

The system as disclosed herein operates upon a glazing frame with an installed glazing unit. The system requires at least one sill anchor block disposed atop the receptor sill for engagement with the glazing frame. In addition, at least one head retention clip engages with the upper horizontal interior receptor frame and the upper interior horizontal glazing frame. The at least one head retention clip is adjusted to achieve the designed compression of the gasket.

It is an object of the system disclosed herein to provide a means to adjustably compress the glazing leg gasket installed within the receptor frame.

It is a further object of the kit disclosed herein to provide a highly cost-effective and readily obscurable from view means for achieving the desired uniform compression of the glazing leg gasket.

It is a further object of the kit disclosed herein to achieve an adequate and uniform pressure on the glazing gasket that will inhibit air and water infiltration.

It is a further object of the kit disclosed herein to provide a uniform contact pressure of four to six pounds per inch upon the glazing gasket to achieve a watertight seal.

These embodiments are intended to be within the scope of the invention herein disclosed. These and other embodiments of the present invention will become clear to those skilled in the art from the following detailed description of the preferred embodiments having reference to the attached figures, the invention not being limited to any preferred embodiment disclosed.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Figure 1:
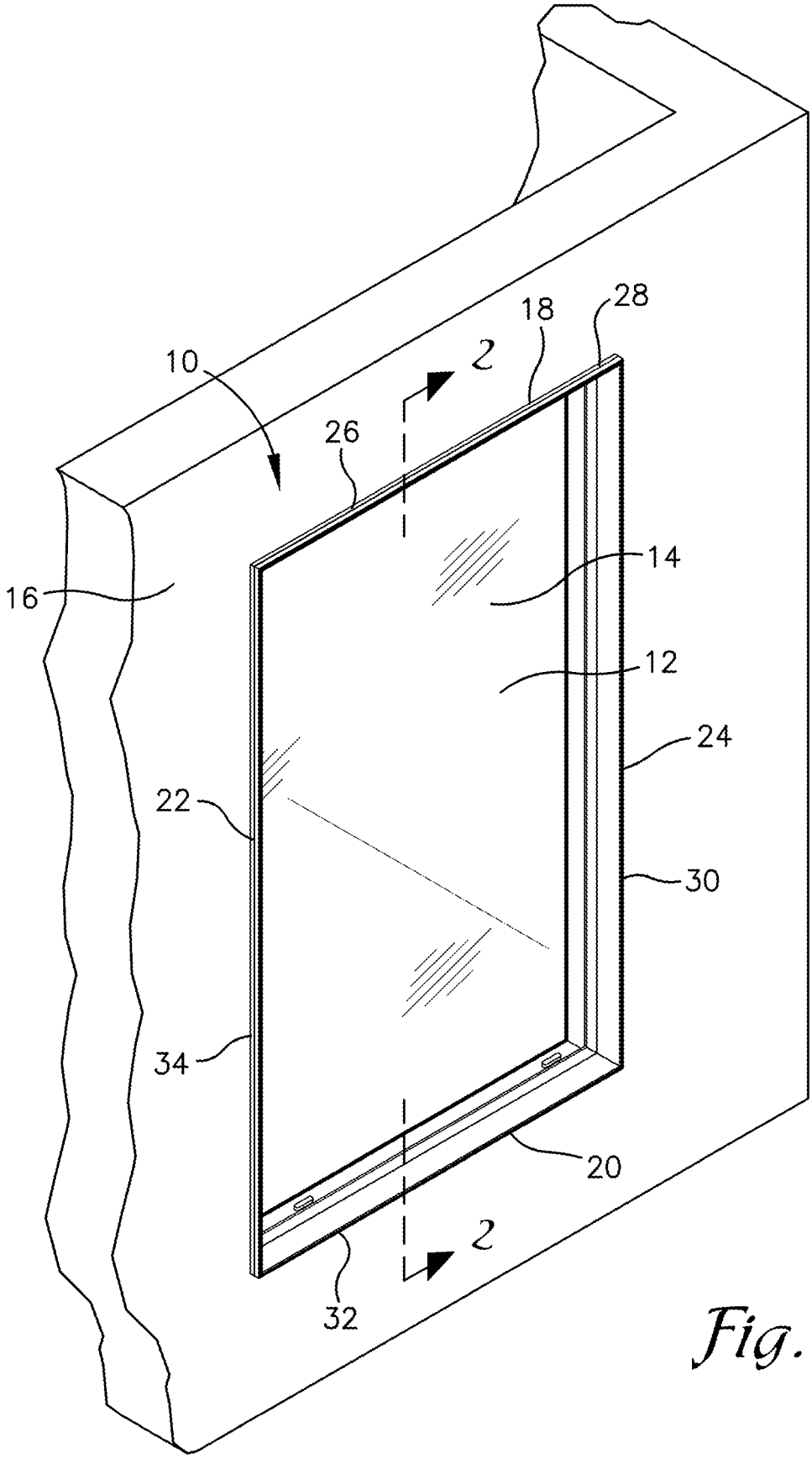
FIG. 1 illustrates a perspective view of embodiments of a glazing unit and a receptor installed within a building penetration.

FIG. 1 reveals an installed dry install receptor system 10 with an associated glazing unit 12 filling a penetration 14 in an exterior facing building wall 16. The penetration 14 typically, but not necessarily, has four surfaces 18, 20, 22, 24. Generally, two of the surfaces 18, 20 are horizontally oriented and two surfaces 22, 24 are vertically oriented. The receptor frame 26 sections 28, 30, 32, 34 are secured to the penetration surfaces 18, 20, 22, 24 by the appropriate fasteners based upon building condition that are well known in the industry.

Figure 2:
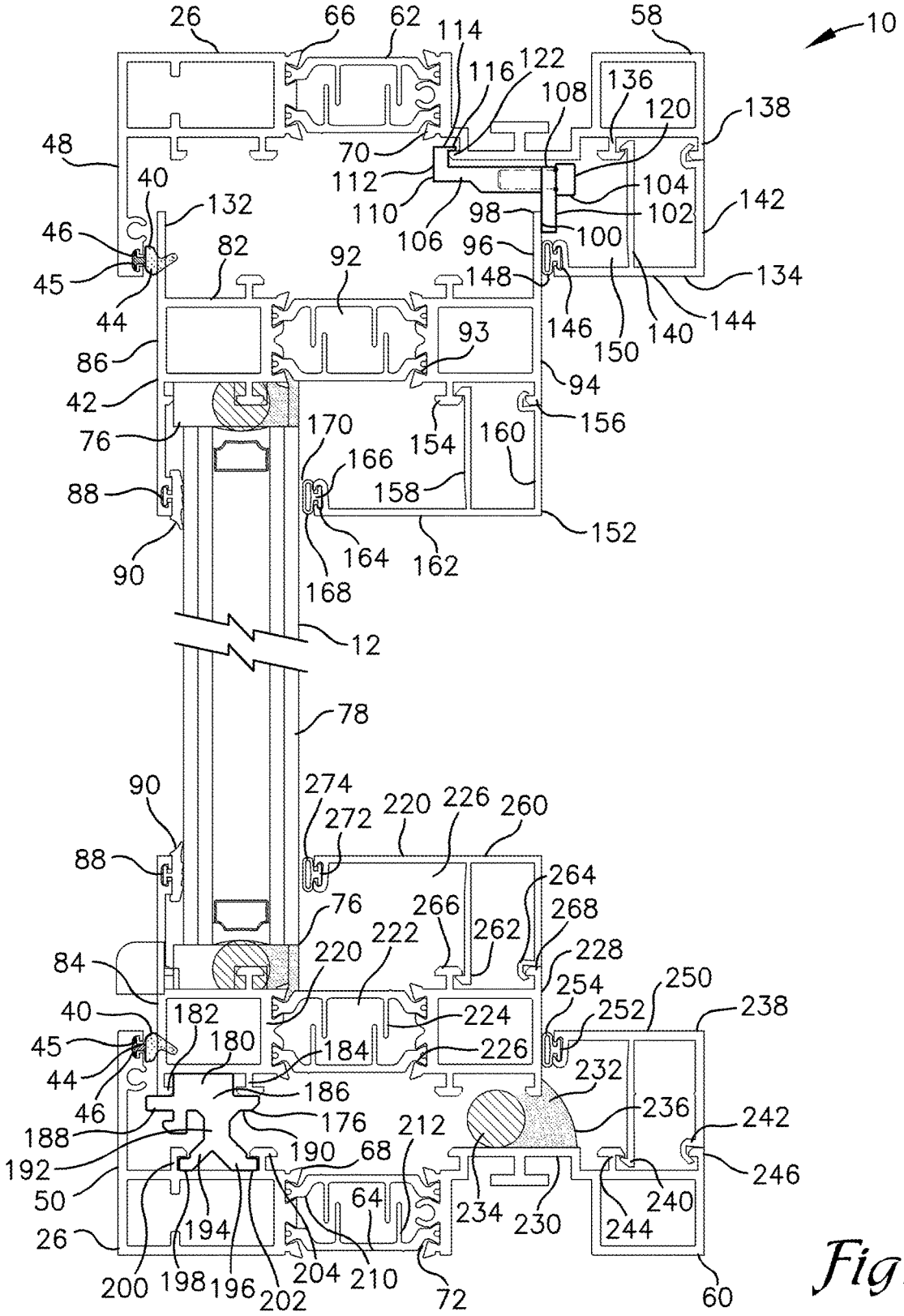
FIG. 2 illustrates a side elevation sectional view of the receptor and glazing unit taken along line 2-2 of FIG. 1.

FIG. 2 illustrates in a sectional view of the installed receptor system 10 along lines 2-2 of FIG. 1 and reveals an embodiment of the elements of the system 10 for maintaining the desired compressive force against a perimeter gasket 44 by the glazing frame 42. As noted above, the glazing frame 42 is installed within and is circumscribed by the receptor frame 26. In general terms, receptor frames are framing components that encase or surround one or more glazing units. Receptor frames are most commonly used to simplify window installation, accommodate variations in size or level/plumbness of window openings, or allow deflection of structural slabs.

The application of appropriate compressive forces by a glazing frame 42 upon the perimeter gasket 44 is critical to maintaining a tight seal to prevent intrusion of air and moisture at the interface 40 of the glazing frame 42 and the receptor frame 26. The system 10 as disclosed herein provides hardware components to achieve the designed compression of the perimeter gasket 44 by the glazing frame 42 installed within the receptor frame 26.

Figure 3:
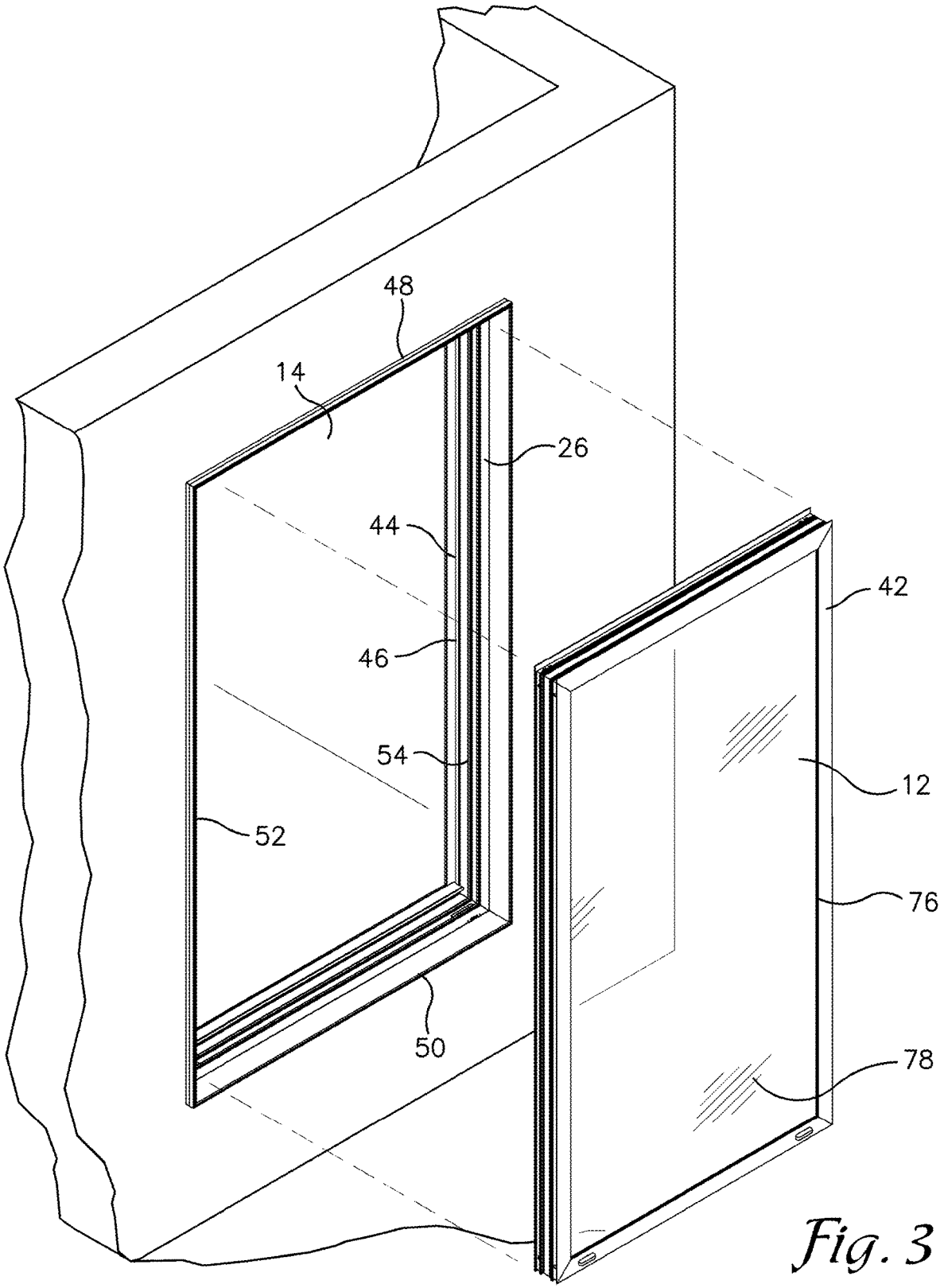
FIG. 3 illustrates a perspective view of an assembly view of a glazing unit ready for insertion into an embodiment of a receptor that in turn is ready for insertion into a building penetration.

To provide overall context for the kit and system 10 disclosed herein, FIG. 3 illustrates a building penetration 14, a receptor 26 installed therein and glazing unit 12 within a glazing frame 42 ready for installation within the receptor frame 26. The receptor frame 26, as seen in FIG. 3 is already installed within the building penetration 14 and the glazing unit 12, with an associated glazing frame 42, is ready for insertion into the receptor frame 26. As seen in FIGS. 2 and 3, the perimeter gasket 44 is installed in a channel 46 that spans the entire perimeter of the receptor frame 26, to include the horizontal exterior receptor dies 48, 50 (upper and lower) which are shown in FIG. 2. The perimeter gasket 44 is installed in the channel 46 of the two horizontally oriented exterior receptor dies 48, 50 as well as the two oppositely disposed exterior vertically oriented receptor dies 52, 54 (as best shown in FIG. 3). The perimeter gasket 44 preferably has a T-shaped extension 45 that is received into and is secured by the channel 46.

As seen in FIG. 2, separating the horizontal exterior receptor dies 48, 50 from the horizontal interior receptor dies 58, 60 are thermal breaks 62, 64. The thermal breaks are preferably fabricated from materials that have a low thermal conductivity such as engineered plastics. As discussed above, the receptor frame segments, to include two vertical 30, 34 and two horizontal sections 28, 32 are preferably secured to the wall penetration surfaces 18, 20, 22, 24 with necessary fasteners (not shown) passing through the receptor frame sections and into the penetration surfaces.

The thermal breaks 62, 64 are preferably configured to facilitate engagement with the horizontal exterior receptor dies 48, 50 on a first end surface 66, 68 and the horizontal interior receptor dies 58, 60 on the opposite end surface 70, 72. A wide range of end surface engagement configurations are contemplated by this disclosure. As noted above, the receptor frame sections 28, 30, 32, 34 to include the two oppositely disposed horizontal and two oppositely disposed vertical sections that include both the exterior and interior receptor sections are secured to the wall penetration surfaces by fasteners thereby rigidly securing the receptor frame 26 to the wall penetration surfaces.

The glazing unit 12, as previously noted and as seen in FIG. 3, is surrounded by a glazing frame 42. The glazing frame 42 protects the edges 76 of the one or more glass sheets 78 and facilitates the engagement of the glazing unit 12 within the receptor frame 26. As seen in FIG. 2, the glazing frame 42 includes an upper horizontal frame die 82 and a lower horizontal frame die 84. The upper exterior horizontal frame die 82 includes a flange 86 that extends downwardly and upwardly and terminates proximate a channel 88 into which a second gasket 90 is installed. This gasket 90 prevents intrusion of air and moisture between the flange 86 and the exterior facing glass sheet 78. Adjacent the upper horizontal frame die and coupled thereto by standard engagement/retention members 93 is a thermal break 92 that resists the transfer of thermal energy between the upper exterior horizontal frame die 82 and the interior frame die 94.

As seen in FIG. 2, the upper interior frame die 94 also includes an upwardly extending flange member 96. The distal end 98 of the interior facing surface 100 of this flange 96 engages with the downwardly extending plate 102 of the head retention clip 104. The head retention clip 104 also includes a main body member 106 with a front edge 108 and a rear edge 110. A wall member 112 extends upwardly from the rear edge 110 of the main body member 106. The wall member 112 includes an upper surface 114 along with a flange 116 extending outwardly from the upper surface 114 of the wall 112. As previously noted, the plate 102 extends downwardly from the front edge 108 of the main body member 106, the plate being secured to the main body 106 with at least one adjustable fastener 120.

As seen in FIG. 2, the flange 116 of the wall member 112 is configured to overlap and engage with a short horizontal flange 122 of the upper interior horizontal receptor die 58 while the plate 102 overlaps a portion of the interior facing surface 100 of the flange 96 of the upper interior frame die 94. This overlapping engagement and the repositionability of the plate 102 allows a force to be applied to the flange 96. That force is transmitted through the flange 96 to the main body of the upper interior frame die 94. Because of the connectivity between the frame die 94 and the thermal break 92 that force is transferred into the thermal break 92. The force is again transmitted through the thermal break 92 and due to the connectivity with the upper exterior frame die 82 the force passes to the frame die 82. The frame die 82, as previously noted, includes an upwardly extending flange 86. Proximate the distal end 132 of the flange 86, the flange 86 engages with the perimeter gasket 44 that is secured in position with a T-extension 45 positioned within the channel 46 of the horizontal exterior receptor die 48.

Figure 4:
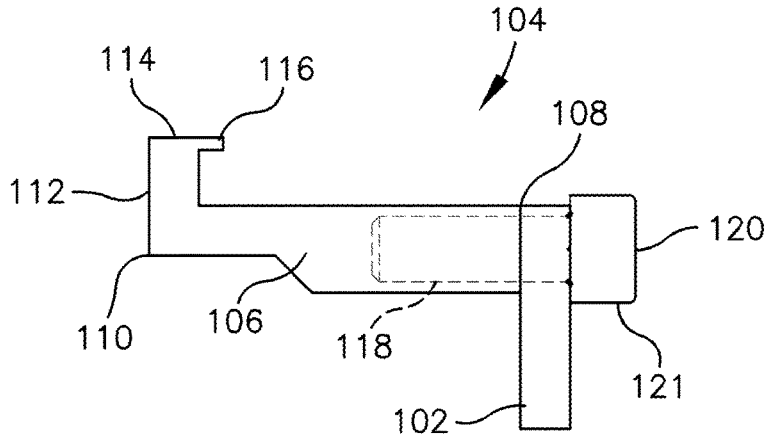
FIG. 4 is a side view of an embodiment of a head anchor clip in position atop a receptor frame.
Figure 5:
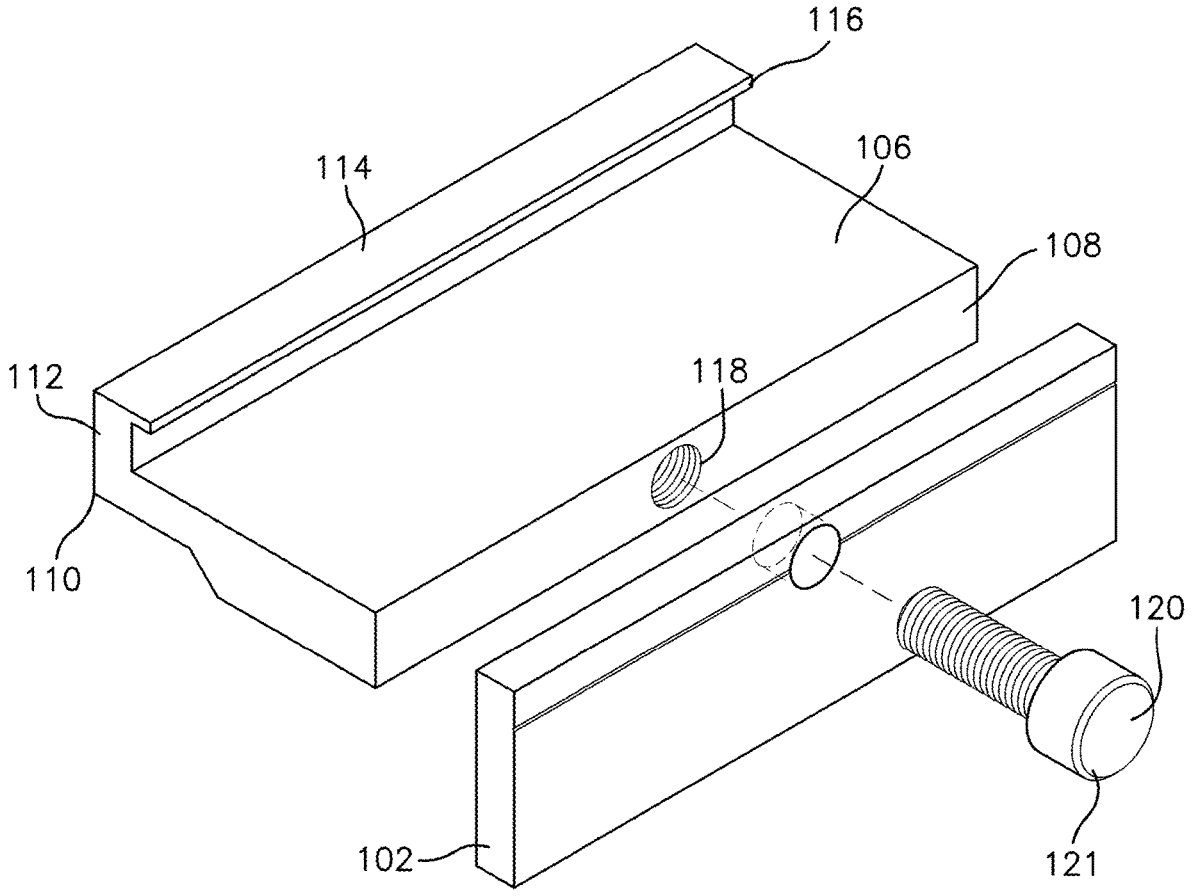
FIG. 5 is an isometeric exploded view of an embodiment of a head retention clip.

The counteracting force applied by the upper interior frame die 94 pushes against the plate 102 when the adjustable fastener 102 is engaged against the flange 96 and the force is transferred to the wall 112 of the main body member 106. The wall 112 then transfers the load to the short horizontal flange 122. Since the short horizontal flange 122 and the entire horizontal interior receptor die 58 is preferably fabricated from an inflexible material the flange does not flex or compress when the adjustable fastener 120 is advanced into the threaded opening 118. Moreover, since the horizontal interior receptor die 58, as well as the entire receptor frame 26, are fastened to the surfaces 18, 20, 22, 24 surrounding the building penetration 14, a horizontal force applied to the inflexible flange 122 causes the plate 102 of the adjustable fastener 120 to translate the flange 96 of the upper interior frame die 94. FIGS. 4 and 5 provide standalone images of the head retention clip assembly in a side elevation view and a perspective view. Each application of the system disclosed herein may utilize a head retention clip of a customized longitudinal extension. In some applications the clip assembly may preferably be shorter than in other applications and is dependent upon the professional judgment of the window fabricator.

The force that is passed through the various components of the glazing frame 42 beginning at the adjustment of the adjustable fastener 120 is transferred to the perimeter gasket 44. As the adjustable fastener 120 is moved forward into the main body member 106 the force transferred to the perimeter gasket 44 increases and the compression of the gasket increases. The compression reaches an optimal level when intrusion of moisture and air is reduced to the greatest extent practicable.

Once the adjustable fastener 120 of the head retention clip 104 is properly adjusted and access to the fastener 120 is no longer needed, the retention clip 104 is preferably obscured from view by the casual observer. To obscure the view of an observer, the retention clip 104 is covered with a receptor glazing bead 134. The upper receptor glazing bead preferably employs engagement means that are well known in the art. For example, engagement legs 136, 138 extending downwardly from the upper interior receptor 58 engage with mating leg structures 140, 142 internal to the glazing bead 134.

In addition, a horizontally extending member 144 of the glazing bead 134 terminates in a channel 146 that is configured for retaining a glazing bead gasket 148 in position. The glazing bead gasket 148 contacts the interior facing surface 100 of the flange 96 and seals the interior space 150 of the glazing bead against infiltration of air and water while also obscuring the view of the retention clip 104. The glazing bead 134 can readily be removed and reattached due to the releasable engagement configuration of the legs 136, 138 and the mating leg structures 140, 142.

To further enhance the aesthetic appeal of the interior facing features of the upper portions of the window, a second horizontally running glazing bead 152 is utilized. The second glazing bead 152 is detachably secured to the upper interior frame die 94. Projecting downwardly from the frame die 94 are engagement legs 154, 156 that engage with mating leg structures 158, 160. Extending perpendicular to the mating leg structures 158, 160 is the glazing bead horizontal cover plate 162. The second horizontally spanning glazing bead 152 also provides supplemental compressive forces against the second gasket 90.

The cover plate 162 terminates at a channel 164 that retains a T-leg 166 of the sealing gasket 168 in position along the entire length of the window surface 170 sealing the interior space 172 of the glazing bead 152 against moisture and air intrusion. Because of the detachable configuration of the engagement legs 154, 156 and the mating leg structures 158, 160 the glazing bead 152 can quickly be removed and replaced if damaged. The adjustment of the plate 102 of the head retention clip 104 also serves to regulate the pressure applied to the sealing gasket 168 and therefore aids in maintaining an appropriate level of compression of the sealing gasket 168.

Figure 6:
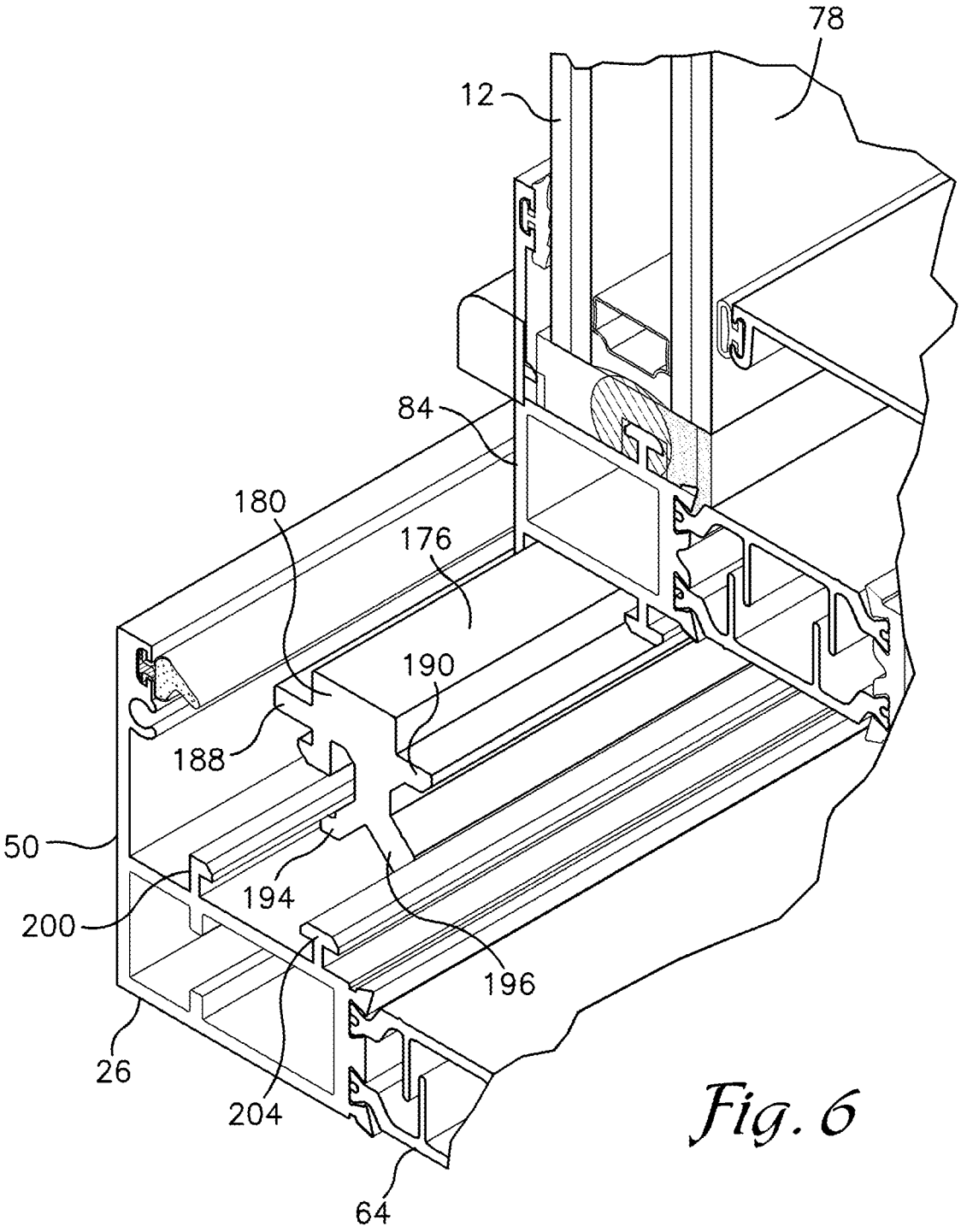
FIG. 6 is a perspective view of an embodiment of the sill anchor block.
Figure 7:
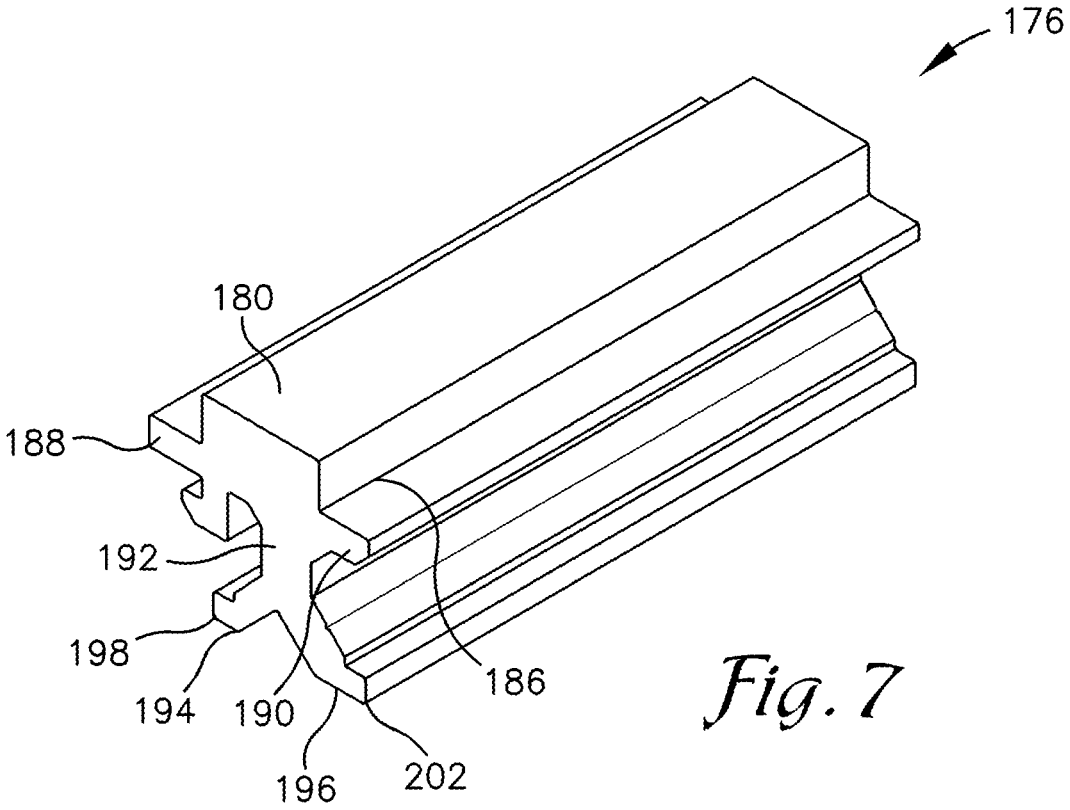
FIG. 7 is a perspective view of an embodiment of a sill anchor block.
Figure 8:
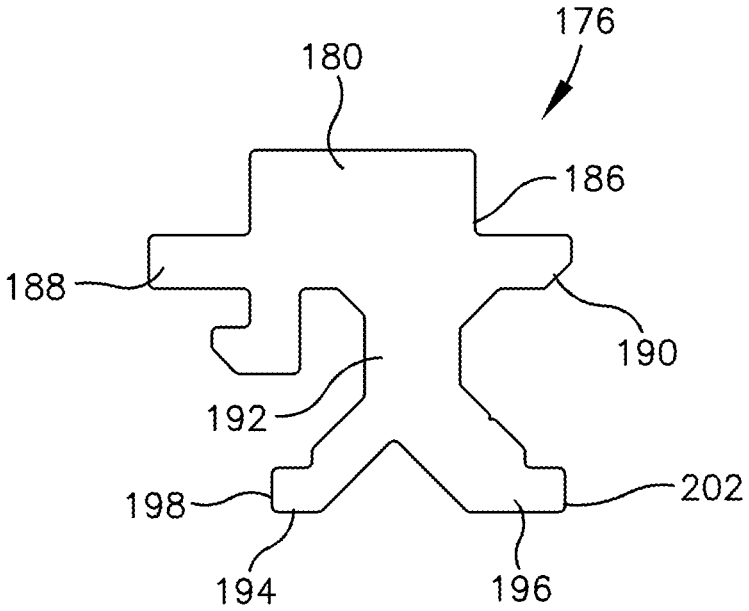
FIG. 8 is a side elevation view of the embodiment of the sill anchor block of FIG. 7.

Moving now to the lower area of the glazing and receptor frames 26, 42 the lower horizontal frame die 84 is positioned immediately beneath the glazing unit 12. Positioned beneath the lower horizontal frame die 84 of the glazing frame 42 is the sill anchor block 176 which can be seen in FIG. 2 and in a perspective installed view at FIG. 6. The anchor block 176 can also be seen in a stand-alone perspective view at FIG. 7 and a side elevation view at FIG. 8. The sill anchor block 176 provides the capacity to resist movement of the glazing frame 42, and aligns the frame properly within the receptor. The sill anchor block 176 is preferably fabricated from an inflexible and non-compressible material such as extruded aluminum but other materials are also contemplated by this disclosure. The anchor block 176 extends longitudinally beneath the horizontal frame die 84 and in a preferred embodiment spans a few inches, the precise span dependent upon design considerations.

The upper area of the anchor block 176 includes a locking segment 180 that extends between two downwardly extending engagement members 182, 184 of the horizontal frame die 84. When installed, the locking segment 180 extends upwardly between and is either closely spaced from, or slightly interferes with, the two engagement members 182, 184. The first engagement member 182 on the exterior side of the window and the second engagement member 184 on the interior side of the window. At the base 186 of the locking segment 180 extend two horizontal arms 188, 190. The first horizontal arm 188 extends toward the exterior facing side of the window and is disposed immediately below the first downwardly extending engagement member 182 and forms a shelf upon which the engagement member 182 rests. The second horizontal arm 190 resides immediately below the engagement member 184 on the interior side of the window and supports the engagement member 184.

Extending downwardly from the main body 192 of the sill anchor block 176 are first and second leg members 194, 196. The first leg member 194 is canted outwardly toward the exterior facing side of the window at an angle of between about 30 to 55 degrees with a distal end 198. The distal end 198 of the first leg member 194 is positioned against a first engagement member 200 extending upwardly from the lower horizontal exterior receptor die 50. The second leg member 196 is also canted outwardly toward the interior side of the window preferably at an angle of between about 30 to 55 degrees and terminates at a distal end 202. The distal end 202 of the second leg member 196 is positioned against a second engagement member 204 that extends upwardly from the lower horizontal exterior receptor die 50.

With the first and second leg members 194, 196 firmly anchored between the engagement members 200, 204 of the horizontal exterior receptor die 50 and the lower horizontal exterior receptor die 50 firmly anchored with fasteners (not shown) to the wall penetration surface 20, even the slightest movement of the sill anchor block 176 toward either the interior, or exterior, of the building is greatly constrained. Since movement of the sill anchor block 176 is greatly constrained and the locking segment 180 extends between the two engagement members 182, 184 the lower horizontal frame die 84 of the glazing frame 42 is also greatly constrained against movement toward or away from the interior, or exterior, of the building penetration 14.

Constraint against movement of the glazing frame 42 is a critical attribute that the sill anchor block 176 brings to the dry install receptor system 10 disclosed herein. The sill anchor block 176 serves to maintain the position of the lower horizontal frame die 84 against the perimeter gasket 44. The sill anchor block 176 works in coordination with the head retention clip 104 to maintain a uniform compression of the entire circumference of the perimeter gasket 44. When the adjustable fastener 120 is rotated into the main body 106 of the retention clip 104 the fastener head 121 pushes against the downwardly extending plate 102 that drives the upwardly extending flange member 96 in the direction of the perimeter gasket 44.

Equally important, and as discussed above, the advancement of the downwardly extending plate 102 drives the upper interior frame die 94 into the thermal break 92 which in turn drives the upper horizontal frame die 82 toward the exterior of the window. As the upper horizontal frame die 82 advances toward the exterior of the window the perimeter gasket 44 is compressed against the distal end of the flange 86 of the upper horizontal frame die 82. The compression of the perimeter gasket 44 increases with the advance of the adjustable fastener 120 into the main body 106 of the head retention clip 104 and the advance of the downwardly extending plate 102 against the upwardly extending flange 96 of the upper interior frame die 94.

The ability to fine tune the adjustable fastener 120 permits the installer to compress the circumscribing perimeter gasket 44 to an extent that optimizes the sealing capacity of the gasket. A perimeter gasket 44 that is insufficiently compressed will result in a gasket that permits moisture and air to pass. Consequently, the chief benefit of the system 10 as disclosed herein is that the window installer can easily adjust the pressure that is applied to the perimeter gasket 44 at a convenient location interior to the building and have confidence that the pressure applied to the gasket will remain upon the gasket once the installation is complete.

Consistent with the configuration of the upper portion 48 of the window receptor frame 26 detailed above, adjacent the lower horizontal exterior receptor die 50 is the lower receptor frame thermal break 64. The thermal break 64 utilizes engagement and retention members 210, 212 on opposing sides 214, 216 to engage with the lower horizontal interior receptor frame 60 at an engagement surface 72 and the lower horizontal exterior receptor die 50. Both the lower horizontal interior and exterior receptor frames 50, 60 are secured preferably with threaded fasteners (not shown) to the lower surface 20 of the building penetration 14.

Extending toward the interior of the building and detachably secured by the engagement and retention members 220 of the lower horizontal frame die 84 is a thermal break 222. The thermal break 222, as previously detailed, is preferably fabricated from material that exhibits low thermal conductivity thereby retarding the transfer of heat into, or out of, the building. The interior facing side 224 of the thermal break 222 also includes engagement and retention members 226 for engagement with the lower interior frame 228. A horizontal segment 230 of the lower horizontal interior receptor frame 60 resides below the lower interior frame die 228 and a vertical gap 232 between the two is preferably sealed initially with a backer rod 234 and any remaining portion of the gap 232 is filled with a flexible sealant 236.

To obscure the flexible sealant 236 from view by a casual observer, a lower horizontal receptor frame glazing bead 238 is preferably installed. The glazing bead 238 is retained in position with engagement members 240, 242 that engage with the engagement members 244, 246 of the lower horizontal interior receptor frame 60. The upper horizontal shelf 250 of the glazing bead 238 terminates in a longitudinally extending channel 252 that retains a gasket 254 that presses against a vertical wall 256 of the lower interior frame 228 upon installation of the glazing bead 238. This gasket seals against intrusion of moisture and air in proximity to the receptor 60.

The final component is the interior upper glazing bead 260 that includes engagement members 262, 264 that extend downwardly for interaction with engagement members 266, 268 that extend upwardly from the lower interior frame member 228. The upper horizontal surface 270 of the glazing bead 260 at a distal end terminates at a channel 272 that retains a longitudinally extending gasket 274. Once the glazing bead 260 is installed into position, the gasket is positioned against a insulating glass unit (IGU) 78. The role of the gasket 274 is to reduce, or preferably eliminate, intrusion of moisture and air into the interior space 276 of the glazing bead.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

We claim:

1. A system for achieving a specified compression of a glazing leg gasket extending around the entire exterior perimeter of a receptor frame that circumscribes a building penetration, the system comprising;

a glazing unit within a glazing frame, the glazing frame installed within the receptor frame such that the receptor frame circumscribes the glazing frame;

at least one sill anchor block disposed atop a lower horizontal section of the receptor frame for engagement with both the receptor frame and the glazing frame, wherein first and second engagement members extend outwardly from the receptor frame for engagement with the at least one sill anchor block, and glazing frame engagement members engage the at least one sill anchor block opposite the engagement members of the receptor frame, the sill anchor block further comprising a locking segment, a main body, a first and second horizontal arm and a first and second leg, wherein the locking segment spans between the first and second engagement members of the glazing frame such that the first and second horizontal arms of the sill anchor block extend beneath and support the first and second engagement members of the glazing frame; and at least one head retention clip mounted to the receptor frame and operable for engagement with the glazing frame; wherein the at least one head retention clip is adjustable to achieve the specified compression of the glazing leg gasket.

2. The system of claim 1, wherein first and second engagement members extend outwardly from the receptor frame for engagement with the at least one sill anchor block.

3. The system of claim 1, wherein the at least one head retention clip comprises (a) a main body member with a front edge and a rear edge, (b) a wall member extending upwardly from the rear edge of the main body member, the wall member including an upper surface along with a flange extending outwardly from the upper surface of the wall; and (c) a plate extending downwardly from the front edge, the plate secured to the main body with at least one adjustable fastener.

4. The system of claim 3, wherein an upper horizontal receptor frame member comprises a horizontal flange with an upper surface and a forward edge.

5. The system of claim 4, wherein the flange of the head retention clip overlays the upper surface of the horizontal flange of the upper horizontal receptor frame member and the wall member contacts the forward edge of the flange of the upper horizontal receptor frame member.

6. The system of claim 3, wherein the adjustable fastener is operable to adjust the force applied to the glazing frame and to the glazing leg gasket.

7. A kit for compressing a window glazing leg gasket between a glazing frame and a receptor frame, the glazing leg gasket extending around the entire perimeter of the receptor frame, the kit comprising;

at least one sill anchor block disposed atop a lower horizontal section of the receptor frame for engagement with the glazing frame, wherein first and second engagement members extend outwardly from the receptor frame for engagement with the at least one sill anchor block, and glazing frame engagement members engage the at least one sill anchor block opposite the engagement members of the receptor frame, the sill anchor block further comprising a locking segment, a main body, a first and second horizontal arm and a first and second leg, wherein the locking segment spans between the first and second engagement members of the glazing frame such that the first and second horizontal arms of the sill anchor block extend beneath and support the first and second engagement members of the glazing frame; and at least one head retention clip mounted to a horizontal exterior receptor frame and operable to apply a force to the glazing frame, wherein the at least one head retention clip is adjustable to vary the compressive force applied to the glazing leg gasket.

8. A system for maintaining compression of a glazing frame against a glazing leg gasket extending around the entire perimeter of a receptor frame, the system comprising;

the glazing frame with an upper member, a lower member and a pair of laterally opposed side members;

at least one sill anchor block disposed beneath the glazing frame, the at least one sill anchor block comprising;

(a) a longitudinally extending body member;

(b) at least one arm member extending horizontally outward from the body member;

(c) at least one leg member extending downwardly from the body member; and (d) a locking segment disposed between engagement members, wherein the locking segment spans between the first and second engagement members of the glazing frame such that the first and second horizontal arms of the sill anchor block extend beneath and support the first and second engagement members of the glazing frame;

at least one head retention clip disposed for operable engagement with the receptor frame and the glazing frame, the at least one head retention clip comprising;

(a) a main body member with a front edge and a rear edge;

(b) a wall extending upwardly from the rear edge of the main body member, the wall including an upper surface along with a flange extending outwardly from the upper surface of the wall; and (c) a plate extending downwardly from the front edge, the plate secured to the main body with at least one adjustable fastener;

wherein the at least one arm member in combination with the at least one leg member of the sill anchor block restrains the lower member of the glazing frame in position upon the receptor frame, and the wall and flange of the at least one head retention clip engages with a flange of the receptor frame while the plate overlaps a flange of the glazing frame, the at least one adjustable fastener is operable to draw the plate closer to the main body of the head retention clip thereby applying a force to the glazing frame that in turn compresses the glazing leg gasket.

9. The system for maintaining compression of the glazing leg gasket of claim 8, wherein a receptor bead installed after adjustment of the fastener fully obscures the at least one head retention clip.

10. The system for maintaining compression of the glazing leg gasket of claim 8, wherein the flange of the at least one head retention clip is disposed atop the receptor flange.

11. The system for maintaining compression of the glazing leg gasket of claim 8, wherein the receptor comprises a pair of longitudinally extending engagement members that restrict lateral translation of the leg members of the sill anchor block.

12. The system for maintaining compression of the glazing leg gasket of claim 8, wherein the longitudinally extending engagement members span at least a portion of the length of the sill.

13. The system for maintaining compression of the glazing leg gasket of claim 8, wherein the longitudinally extending engagement members span at least a portion of the length of a header.

14. The system for maintaining compression of the glazing leg gasket of claim 8, wherein the at least one leg member extending downwardly from the body member of the sill anchor block are retained in position between the first and second engagement members of the receptor frame.

15. The system for maintaining compression of the glazing leg gasket of claim 8, wherein a receptor bead is positioned over the sill anchor block to obscure the sill anchor block.

16. The system for maintaining compression of the glazing leg gasket of claim 15, wherein the receptor bead is an extruded longitudinally extending member with first and second leg members disposed at approximately 90 degrees from one another.

17. The system for maintaining compression of the glazing leg gasket of claim 8, wherein the at least one adjustable fastener securing the plate to the main body of the head retention clip engages with a threaded opening in the main body.

18. The system for maintaining compression of the glazing leg gasket of claim 8, wherein rotation of the at least one adjustable fastener draws the plate closer to the main body of the head retention clip and applies increasing pressure to the glazing leg gasket and counter-rotation of the at least one adjustable fastener increases the space between the plate and the main body and reduces pressure on the glazing leg gasket.

* * * * *